US007125309B2

(12) United States Patent
Pierson et al.

(10) Patent No.: US 7,125,309 B2
(45) **Date of Patent: *Oct. 24, 2006**

(54) SMART SMOKE UNIT

(75) Inventors: Martin D. Pierson, Howell, MI (US); James M. Rohde, Walled Lake, MI (US)

(73) Assignee: Lionel L.L.C., Chesterfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/696,530

(22) Filed: Oct. 29, 2003

(65) Prior Publication Data

US 2004/0198135 A1 Oct. 7, 2004

Related U.S. Application Data

(63) Continuation of application No. 09/968,959, filed on Oct. 1, 2001, now Pat. No. 6,676,473.

(51) Int. Cl.
*A63H 19/14* (2006.01)

(52) U.S. Cl. ..... 446/25; 446/467

(58) Field of Classification Search ..... 446/24, 446/25, 467, 484; 105/1.5
See application file for complete search history.

(56) References Cited

U.S. PATENT DOCUMENTS

| | | | | |
|---|---|---|---|---|
| 3,665,681 | A | 5/1972 | Vitenko | 55/260 |
| 3,891,826 | A | 6/1975 | Seuthe et al. | 219/273 |
| 4,198,992 | A | 4/1980 | Smith | 131/171 |
| 4,332,101 | A | 6/1982 | Tomita | 46/9 |
| 4,374,038 | A | 2/1983 | Tamura | 516/3 |
| 4,741,717 | A | 5/1988 | Wolf | 446/24 |
| 4,871,115 | A | 10/1989 | Hessey | 239/136 |
| 5,069,230 | A | 12/1991 | Green | 131/330 |
| 5,205,771 | A | 4/1993 | Sims | 446/21 |
| 5,312,281 | A | 5/1994 | Takahashi et al. | 446/25 |
| 5,334,071 | A | 8/1994 | Mills | 446/186 |
| 5,512,001 | A | 4/1996 | Kent et al. | 446/25 |
| 5,610,359 | A | 3/1997 | Spector et al. | 89/1.11 |
| 5,870,524 | A | 2/1999 | Swiatosz | 392/394 |
| 5,896,017 | A | 4/1999 | Severson et al. | 312/280 |
| 5,944,502 | A | 8/1999 | Denchfield | 431/1 |
| 6,019,289 | A | 2/2000 | Sung | 238/10 E |
| 6,106,356 | A | 8/2000 | Trageser | 446/429 |
| 6,280,278 | B1 | 8/2001 | Wells | 446/25 |
| 6,281,606 | B1 | 8/2001 | Westlake | 307/125 |
| 6,457,681 | B1 | 10/2002 | Wolf et al. | |
| 6,485,347 | B1 * | 11/2002 | Grubba et al. | 446/25 |
| 6,619,594 | B1 | 9/2003 | Krebiehl et al. | |
| 6,624,537 | B1 * | 9/2003 | Westlake | 307/125 |
| 6,655,640 | B1 | 12/2003 | Wolf et al. | |
| 6,676,473 | B1 | 1/2004 | Pierson et al. | 446/25 |

* cited by examiner

*Primary Examiner*—Jacob K. Ackun, Jr.
(74) *Attorney, Agent, or Firm*—O'Melveny & Myers LLP

(57) ABSTRACT

A smoke generating unit for a model train that varies the rate of smoke produce in response to changes in the load on the model train. The smoke generating unit includes a housing, a smoke element and a motor driven fan. The housing can be formed of two sub-housings. The first sub-housing can contain the smoke generating element and the second housing can contain the fan. The smoke element can be a nickel chromium wire. An insulating gasket can be positioned between the sub-housings to thermally insulate the motorized fan from the heat generating element. The motorized fan is controlled by a microprocessor that can monitor the load on the train and control rotation of the fan to correspond to the load on the engine. The load on the train can be the voltage across the engine of the train or the speed at which the train is moving.

8 Claims, 4 Drawing Sheets

FIG-1
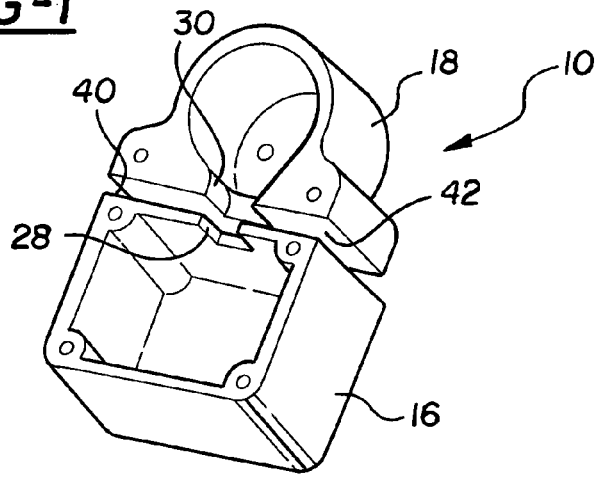
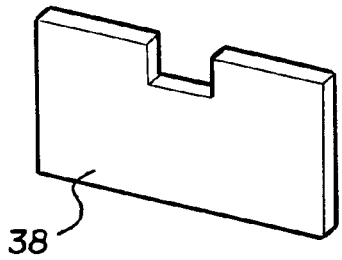
FIG-2
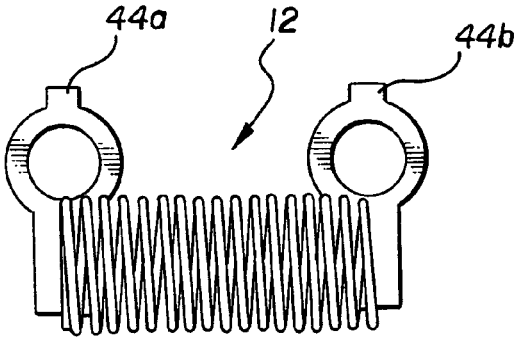
FIG-3A
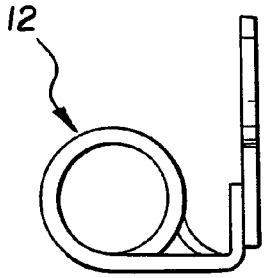
FIG-3B
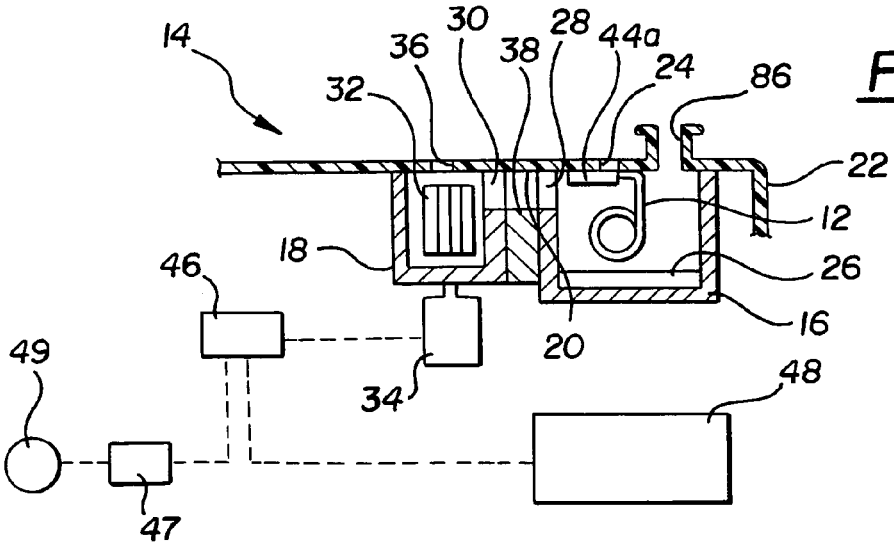
FIG-4

SMART SMOKE UNIT

RELATED APPLICATIONS

This application is a continuation of application Ser. No. 09/968,959, filed Oct. 1, 2001, and issued as U.S. Pat. No. 6,676,473 on Jan. 13, 2004.

INCORPORATION BY REFERENCE

U.S. application Ser. No. 09/968,959 entitled SMART SMOKE UNIT was filed on Oct. 1, 2001, issued as U.S. Pat. No. 6,676,473 on Jan. 13, 2004, and is hereby incorporated by reference in its entirety.

FIELD OF THE INVENTION

The invention relates to a smoke generating device for a model train, and, more specifically, the invention provides a smoke generating device that can change the rate of smoke generated in response to load changes experienced by the engine of the model train.

BACKGROUND OF THE INVENTION

Model train engines having smoke generating devices are well known. However, current smoke generating devices for model trains do not mimic the generation of smoke of a real train as closely as desired. Real trains generate smoke at a rate proportional to the loading of the engine of the train notwithstanding the speed at which the train is moving. This characteristic is not available in model toy trains. The heat generated by known smoke generator can cause the smoke generator to fail. The present invention solves these and other problems with the prior art.

SUMMARY OF THE INVENTION

The present invention provides an apparatus for generating smoke for a model toy train. The invention includes a smoke generating element connected to the train to generate smoke. The invention also includes a blower for generating an air stream to direct smoke out of the train. The invention also includes a controller for controlling the blower to generate the airstream at a predetermined rate. The predetermined rate is based on the load on the train.

The invention also provides a method for generating smoke from a model train. Smoke is generated with the smoke generating element connected to the train. A blower generates an air stream to move smoke out of the train. A controller controls the blower to generate the air stream at a particular rate in response to a signal corresponding to the load on the train.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is an isometric view of a housing according to an embodiment of the present invention;

FIG. 2 is an isometric view of an insulating gasket according to an embodiment of the present invention;

FIG. 3A is a front view of a smoke generating element according to an embodiment of the present invention;

FIG. 3B is a side view of a smoke generating element according to an embodiment of the present invention;

FIG. 4 is a cross sectional view of a smoke generating apparatus mounted to a model train according to an embodiment of the present invention;

DESCRIPTION OF THE PREFERRED EMBODIMENT

Figure 5:
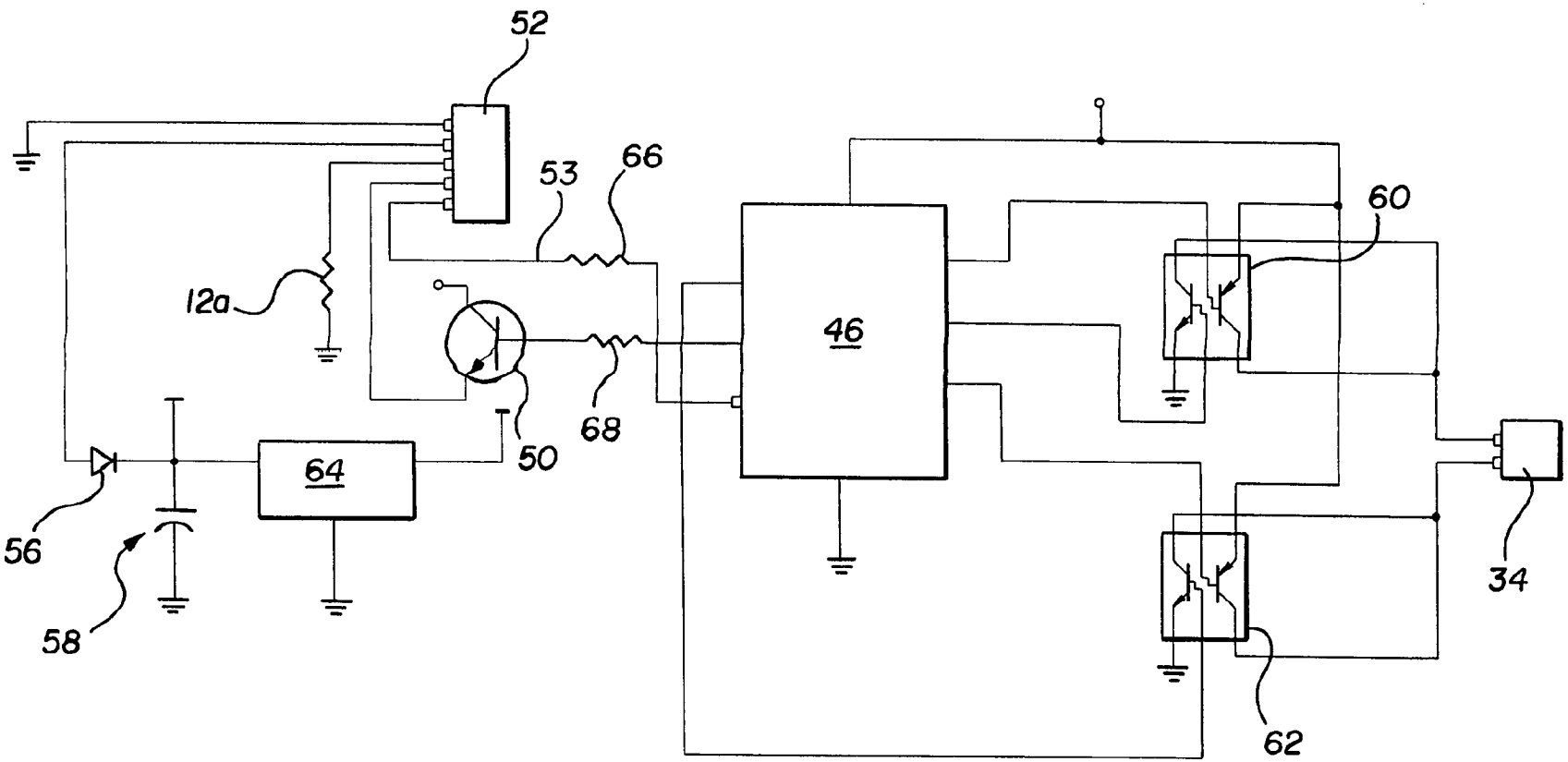
FIG. 5 is a circuit schematic of the smoke generating device according to an embodiment of the present invention.

The present invention provides a smoke generator for a model train. The smoke generator includes a controller, a fan and a smoke generating element. The controller can control the angular velocity of the fan to control a rate of smoke emitted from the model train. The controller can receive input corresponding to a load on the model train and control the fan in accordance with a control program stored in memory. The load on the model train can correspond to a voltage across an engine of the model train or the speed of the model train. The smoke generating element can be a nickel chromium wire. The nickel chromium wire is held in place with fasteners engaged with ends of the wire.

Referring now to FIGS. 1 and 4, the invention includes a housing 10, a smoke generating element 12 and a blower 14 for emitting smoke from a model train 22. The housing 10 includes a first sub-housing 16 and a second sub-housing 18. First sub-housing 16 is mounted to an interior surface 20 of the model train model train 22 and houses oil used in a smoke generating process. Oil is directed through an aperture 24 of model train 22. While an oil burning smoke element is shown, the invention can be practiced with any type of smoke generator and any type of smoke generating process known in the art. For example, the smoke generator can be an ultrasonic wave nebulizer, a device for generating smoke-filled bubbles, or any other method disclosed by the references cited.

The first sub-housing 16 is shown as generally rectangular. First sub-housing 16 can be any geometric shape, such as circular or irregularly shaped. The shape of first sub-housing 16 can be limited only to the extent that the first sub-housing 16 is preferably mounted in the interior of model train 22 and smoke generating element 12 can be extendable into first sub-housing 16.

First sub-housing 16 includes an opening 28. Opening 28 of first sub-housing 16 is aligned with an opening 30 of second sub-housing 18. Openings 28 and 30 place the first and second sub-housing 16 and 18 in fluid communication with each other. Openings 28 and 30 are shown in FIGS. 1 and 4 as generally rectangular in cross-section, however, the openings 28 and 30 can be any geometric configuration. While the first and second sub-housings 16 and 18 are shown positioned adjacent to each other, the invention can be practiced with first and second sub-housings positioned spaced apart relative to each other. A conduit can be positioned between the first and second sub-housings 16 and 18 to place the first and second sub-housings 16 and 18 in fluid communication with each other.

Second sub-housing 18 can be shaped to correspond to the shape of fan 32. In particular, the second sub-housing 18 is circular in shape to correspond to the squirrel cage fan 32 used in the illustrated embodiment. Second sub-housing 18 can be shaped to conform to the style of the fan 32 selected for use in a particular embodiment of the present invention. On the other hand, it is not necessary that the second sub-housing 18 be shaped to correspond to the shape of fan 32. For example, second sub-housing 18 can be rectangular shaped and house a squirrel cage fan 32.

Housing 10 can be fabricated from any material having sufficient rigidity and thermal resistance. Housing 10 supports the blower 14 and the smoke generating element 12. For example, housing 10 can be fabricated from aluminum, steel, cast iron, plastic, or an appropriate alloy. Preferably the housing 10 can be fabricated from an alloy having the trade name "Zamak 3." Zamak is a well known alloy of zinc, copper, aluminum and magnesium. In addition, in an embodiment of the invention including first and second sub-housings 16 and 18, the first and second sub-housings 16 and 18 can be fabricated or formed with different materials.

Referring now to FIG. 2, the present invention can also include a gasket 38. Gasket 38 can thermally insulate the second sub-housing 18 with respect to the first sub-housing 16. Gasket 38 can be advantageous to thermally insulate the blower 14 from thermal energy emitted by smoke generating element 12. Gasket 38 can be shaped to correspond to opposing sides 40 and 42 of first and second sub-housing 16 and 18, respectively, of housing 10. Gasket 38 can be shaped in any desired geometric configuration so long as first and second sub-housings are in fluid communication with respect to each other. In a preferred embodiment of the present invention, gasket 38 is fabricated from silicone rubber rated to 500° F.

Referring now to FIGS. 3A and 3B, smoke generating element 12 includes terminals 44*a* and 44*b* at opposite ends of the smoke generating element 12. Terminals 44*a* and 44*b* are shown as ringlets. The smoke generating element can be kept at a constant temperature and can be formed as a nickel chromium wire. The terminals 44*a* and 44*b* can be integral with the nickel chromium wire of the smoke generating element 12 or can be crimped on the smoke generating element 12. Smoke generating element 12 can be engaged with interior surface 20 by rivets or screws or any other fastening means that can withstand the thermal energy emitted by the smoke generating element 12. As shown FIG. 4, the smoke generating element 12 is mounted to interior surface 20 of model train 22 and extends downwardly into first sub-housing 16.

Referring now to FIG. 4, first sub-housing 16 can include a lamina 26. Lamina 26 is a thin plate, scale or layer made of fibrous material to absorb the oil directed into first sub-housing 16 through aperture 24. Lamina 26 can absorb and retain oil to be heated by the smoke generating element 12. Lamina 26 is operable to withstand the maximum thermal energy generated by the smoke generating element 12.

The second sub-housing 18 is mounted to an interior surface 20 of model train 22 and houses a fan 32 of blower 14 for directing an air stream through the housing 10. In a preferred embodiment of the invention, fan 32 is a squirrel cage fan. However, fan 32 can also be any type of fan including, but not limited to, an axial fan, a radial flow fan, a mixed flow fan or a cross-flow fan. Fan 32 is positioned internally with respect to the second sub-housing 18. A motor 34 for rotating the fan 32 is positioned externally with respect to the second sub-housing 18. However, the invention can be practiced with the fan 32 and the motor 34 positioned internally with respect to the second sub-housing 18. Rotation of fan 32 draws the air stream through an aperture 36 of model train 22. While the aperture 36 is shown positioned adjacent the second sub-housing 18, the invention can be practiced with aperture 36 positioned spaced apart from the second sub-housing 18. A conduit can be positioned between the aperture 36 and the second sub-housing 18, placing the aperture 36 and the second sub-housing 18 in fluid communication with respect to each other. The air stream is directed through openings 30 and 28 into first sub-housing 16.

Referring now to FIG. 5, a schematic circuit diagram is provided showing the preferred electric circuit of an embodiment of the present invention. Controller 46 is a micro-controller operable to receive input signals and emit output signals and can be an PIC 12C508 chip. The controller 46 is in communication with the engine of the train through a serial communication line 53 including the input connector 52. Serial communication line 53 transmits a wide variety of information with regard to model train 22. This information can include but is not limited to the velocity of train 22. Communication between the controller 46 and the input connector 52 can be enhanced with a protection resistor 66. The voltage across the engine of the train is communicated to the controller 46 with serial communication line 53. Based on a program stored in memory, the controller 46 can control the operation of the motor 34 to control an airstream generated by the fan. The controller 46 can control a rate of the airstream. The direction of the motor 34 can be controlled by alternating the voltage across the motor 34 with an H-bridge formed with a pair of chips 60 and 62. The chips 60 and 62 can be XN4316 chips and can be controlled by the controller 46. The velocity of the motor 34 can be changed by changing the level of voltage across the motor 34 with the controller 46. The circuit also includes a voltage stabilizer defined by diode 56, capacitor 58 and regulator 64. The circuit also includes an element 50 that can control a lamp or relay when a command is received.

Figure 6:
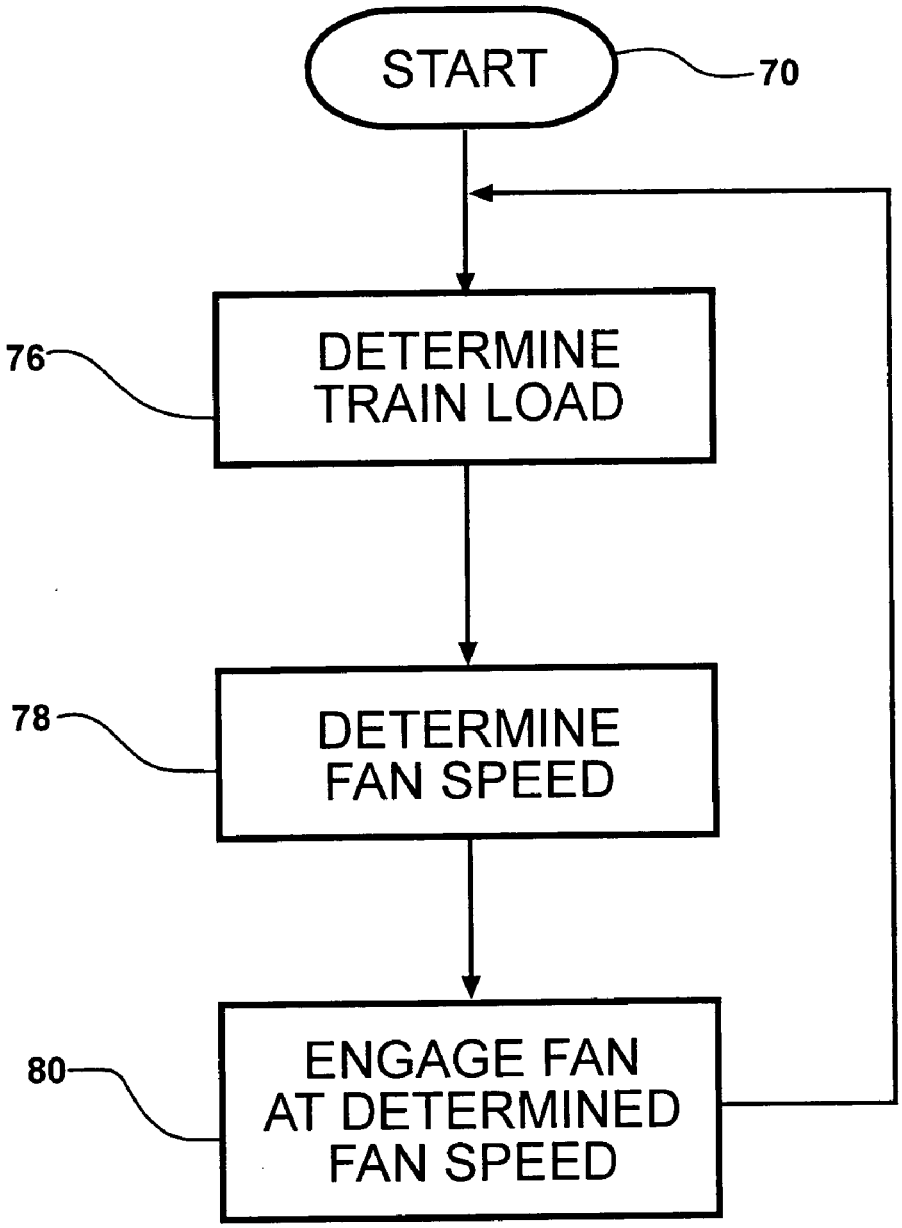
FIG. 6 is a flow diagram illustrating the steps performed by the smoke generating device according to an embodiment of the present invention.

Referring now to FIG. 6, the method for generating smoke begins at step 70. At 76, the loading on the train is determined. The controller 46 can receive input from the communication line corresponding to the loading on the engine model train. The loading on the model train can correspond to a voltage across an engine of the model train or a speed at which the model train is moving. As seen in FIG. 4, the controller 46 can communicate with a sensor 47 engaged with a wheel 49 of the model train 22. The sensor 47 can sense the angular velocity of the wheel 49 and communicate the speed of the wheel 49 to the controller 46.

Figure 7:
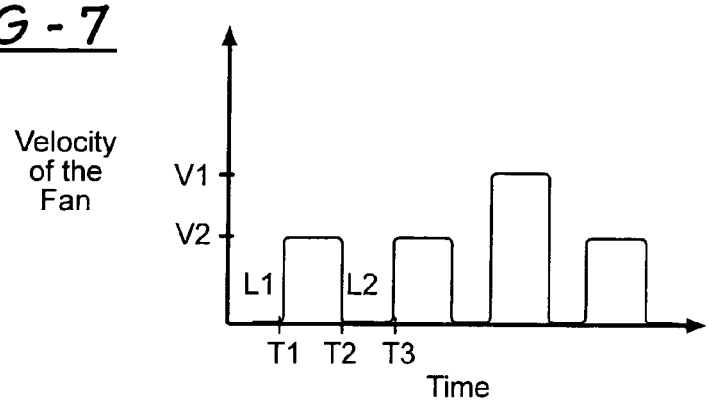
FIG. 7 is a graph illustrating an example of the relationship between the velocity of the fan and time.

Referring to FIG. 6, at 78 the appropriate angular velocity of the fan is determined by the controller in accordance with a control program stored in memory. In FIG. 7, an illustrative graph is provided to show movement of the fan over time to produce a puffing pattern of smoke. A puff of smoke is emitted from an aperture of the model train. The time period lasting from T1 to T2 is the duration of a puff of smoke. The time period lasting from T2 to T3 is the interval between puffs of smoke. Preferably, the fan can be engaged at velocity V1 in as short a period of time as possible, represented by a substantially vertical line L1 on the graph.

Also, the fan 32 can preferably be disengaged from velocity V1 to zero velocity in as short a period of time as possible, represented by a substantially vertical line L2 on the graph. More specifically the smoke unit stops the fan by temporarily reversing the current to motor. By temporarily reversing the current the fan stops abruptly thereby enhancing the puffing action of the smoke unit. As the time periods required to engage the fan up to velocity V1 and disengage the fan 32 down from velocity V1 decrease, a relatively more well defined puff of smoke will be emitted from the aperture of the train.

Figure 8:
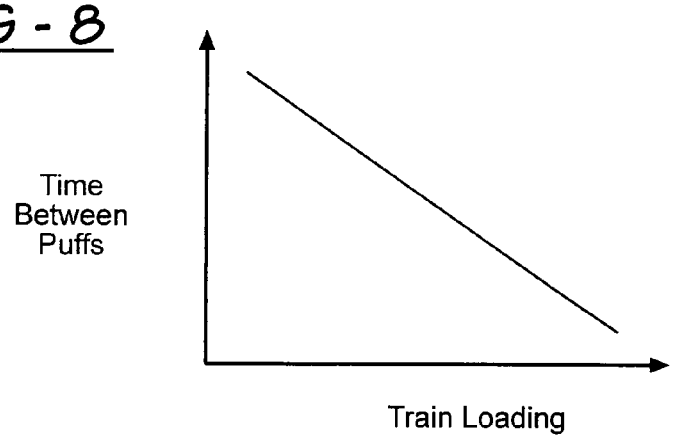
FIG. 8 is a graph illustrating the relationship between the time interval between puffs of smoke and the loading on the engine.
Figure 9:
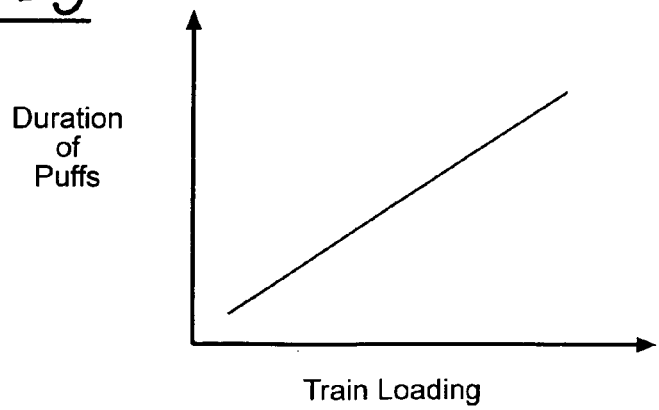
FIG. 9 is a graph illustrating the relationship between the duration of puffs of smoke and the loading on the engine.

As the loading on the train increases, the controller can move the fan at a greater angular velocity, or increase the duration of puffs of smoke, or shorten the duration between puffs of smoke. For example, for a train modeled after a steam locomotive that puffs smoke, the puffs of smoke can be generated at increasing intervals as the train speed increases and can be generated at decreasing intervals as the train speed decreases. Alternatively, the puffs of smoke can be generated at increasing intervals as engine load increases and can be generated at decreasing intervals as the engine load decreases. For a train modeled after a diesel engine that does not emit smoke in a puffing pattern, more smoke can be generated as the train speed increases and less smoke can be generated as the train speed decreases. Alternatively, more smoke can be generated as engine load increases and less smoke can be generated as engine load decreases. Referring now to FIGS. 8 and 9, graphs are provided to show that the time between puffs decreases as loading on the train increases. Also, the duration of individual puffs of smoke increases as loading on the engine increases.

Referring now to FIG. 6, at step 80 the controller engages the motor to rotate the fan at the desired angular velocity. After the fan has been engaged at the desired velocity, the process returns to step 76 to determine loading on the engine. The controller can continuously monitor the loading on the engine or can monitor the loading on the engine at predetermined intervals. For example, the controller can be operable to monitor the loading on the train every five seconds, every ten seconds or any time period desired.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A smoke generator for a model toy train, the model toy train having an electric motor, the electric motor operative in moving the train, the smoke generator comprising:

a smoke generating element to generate smoke;

a fan driven by a fan motor, the fan positioned proximate to the smoke generating element such that an airstream generated by the fan moves the smoke; and a controller for receiving a signal corresponding to a load on the electric motor, wherein the controller is programmed to:

send an output current to the fan motor in response to the received signal, such that the fan motor responds to the output current by driving the fan at a velocity proportional to the received signal; and after a predetermined time period, reverse the output current to the fan motor to abruptly stop the fan, and thereby generate a puffing pattern of smoke.

2. A smoke generator in accordance with claim 1, wherein the controller includes a memory, and the fan is controlled in accordance with a program stored in the memory.

3. A smoke generator in accordance with claim 1, further comprising a gasket for thermally insulating the fan and fan motor, at least partially, with respect to the smoke generating element.

4. A smoke generator in accordance with claim 1, wherein the smoke generating element is formed of nickel and chromium.

5. A smoke generator in accordance with claim 4, wherein the smoke generating element includes a wire having opposite ends and the opposite ends of the wire are engaged with a terminal.

6. A smoke generator in accordance with claim 1, wherein the fan is at least one of a fan selected from the group consisting of an axial fan, a radial flow fan, a mixed flow fan and a cross flow fan.

7. A smoke generator in accordance with claim 1, wherein a housing is operably associated with the train, the housing having interconnected first and second sub-housings in fluid communication with respect to each other, the first sub-housing at least partially enclosing the smoke generating element, the second sub-housing at least partially enclosing the fan and fan motor.

8. A smoke generator in accordance with claim 1, wherein the controller is operative to stop the fan motor by reversing voltage applied to the fan motor.

* * * * *